United States Patent [19]

Mosier et al.

[11] 4,244,576

[45] Jan. 13, 1981

[54] GOLF PRACTICE APPARATUS

[76] Inventors: Jack M. Mosier; Jeanette E. Mosier, both of 606 Ocean Ave., Seal Beach, Calif. 90740

[21] Appl. No.: 932,556

[22] Filed: Aug. 10, 1978

[51] Int. Cl.[3] ..... A63B 69/36

[52] U.S. Cl. ..... 273/176 F; 273/199 R; 273/DIG. 30; 273/176 J; 273/162 E; 273/176 B

[58] Field of Search ..... 273/181 A, 181 B, 177 R, 273/178 B, 58 K, 176 J, 179 R, 179 C, DIG. 30, 33, 195 A, 176 F, 95 R, 176 H, 199 R; 46/DIG. 1

[56] References Cited

U.S. PATENT DOCUMENTS

| | | | |
|---|---|---|---|
| 2,124,123 | 7/1938 | Rosengarten | 273/33 |
| 2,668,711 | 2/1954 | McLaughlin | 273/195 A |
| 2,786,683 | 3/1957 | Shapiro | 273/195 A |
| 3,038,726 | 6/1962 | Hesidence | 273/176 F |
| 3,323,802 | 6/1967 | Riner | 273/195 A |
| 3,578,333 | 5/1971 | Elesh | 273/178 B |
| 3,601,406 | 8/1971 | Giusti | 273/181 B X |
| 3,857,566 | 12/1974 | Lemelson | 273/95 R |
| 3,936,055 | 2/1976 | Scott | 273/176 H |
| 3,940,145 | 2/1976 | Gentiluomo | 273/199 R X |
| 4,057,252 | 11/1977 | Pelton | 273/181 A X |

FOREIGN PATENT DOCUMENTS 2254275 11/1973 Fed. Rep. of Germany ..... 46/DIG. 1

*Primary Examiner*—George J. Marlo

*Attorney, Agent, or Firm*—Woodard, Weikart, Emhardt & Naughton

[57] ABSTRACT

A golf practice apparatus for pitching, chipping and putting includes a pitching mat, a chipping-putting mat, a putting green mat and a lighter-than-regulation-weight golf ball. The golf ball includes a plurality of strips of hook-like projections extending around the golf ball in a spaced apart arrangement. The putting green mat has a top surface of loop-like fibers which are capable of interlocking engagement with the hook-like projections on the golf ball in order to restrict the movement of the golf ball as it travels across the top surface of the putting green mat. The pitching and chipping-putting mats include artificial turf material which permits rolling freedom thereacross by the golf ball. The pitching mat may be positioned at any number of different distances from the chipping-putting mat which is contiguous with the putting green mat so that different length pitching and chipping shots can be practiced. The golf ball may be hit from the pitching mat onto the chipping-putting mat where it will bounce and roll up toward the putting green mat which has a golf cup hole disposed therein. Variations on this embodiment are also disclosed wherein alternative designs may be utilized in a similar manner.

4 Claims, 11 Drawing Figures

GOLF PRACTICE APPARATUS

BACKGROUND OF THE INVENTION

This invention relates in general to golf practice apparatus and in particular to such apparatus which are designed for indoor use.

Success in the game of golf requires a certain degree of individual skill in the manipulation of the various clubs and a feel for distances and course conditions. Developing a "feel" for distances and course conditions must be acquired by practice and by playing various courses under a variety of conditions. As one acquires a certain degree of ability in playing the game of golf, physical conditioning and continued practice with the various clubs permits the golfer to manipulate these clubs time after time in a somewhat consistent manner so that he can maintain his level of proficiency at the game.

In order to permit practicing with golf clubs at locations which are remote from a golf course, various concepts have been advanced. For example, a driving range provides one alternative to on-course practicing of long and medium-range shots, but this is still an out-of-doors activity, and is not suitable for the golfer who wishes to conveniently practice only five or ten minutes at any one time. Consequently, apparatus have been conceived in order to permit practicing of golf shots, such as putting, indoors so that practice is possbile for brief as well as extended periods of time regardless of weather conditions and virtually regardless of space limitations. Typically though, these apparatus have been limited solely to putting and means for practicing chipping and pitching shots are not available. The following listed patents provide some indication of what has been conceived in the area of indoor sports apparata and in particular golf apparata.

| U.S. Pat. No. | Patentee | Issue Date |
|---|---|---|
| 3,038,726 | Hesidence | 6/12/62 |
| 2,786,683 | Shapiro | 3/26/57 |
| 3,323,802 | Riner | 6/06/67 |
| 2,124,123 | Rosengarten | 7/19/38 |
| 2,668,711 | McLaughlin | 2/09/54 |
| 3,936,055 | Scott | 2/03/76 |
| 3,940,145 | Gentiluomo | 2/24/76 |
| 3,857,566 | Lemelson | 12/31/74 |

Hesidence discloses a practice putting apparatus wherein a strip of spongy material is arranged with a backstop at each end and a golf cup hole adjacent thereto.

Shapiro discloses a golf practice device which includes a mat having its entire upper surface provided with upstanding flexible protuberances, a tripod tee device and a thin and hollow ball with numerous perforations to increase air resistance for practice purposes.

Riner discloses a putting rug which includes removable circular sections such that when a section is removed the void which remains simulates a golf cup hole.

Rosengarten discloses a golf practice mat wherein a missile-disc is disposed within the top surface of the mat which consists of wire-like bristles set in a fabric base and backed by a sheet of sponge rubber.

McLaughlin discloses a golf tee mat which includes a top layer of upwardly projecting fibers which are resilient in character and to some extent resemble turf.

Scott discloses a golf shot practice stage which includes a frame having side panels which define "green" and "fairway" playing surfaces. The panels are positionable at different angles to the horizontal in order to enable practice with different ball lies. The stage is foldable into compact form for storage.

Gentiluomo discloses a golf ball construction which includes a spherical coherent impact damping mass which is operative to dissipate golf club impact energy such that limited rebound energy is available for ball propulsion. This patent is cited for its disclosure of golf ball-like objects which are lighter in weight than are regulation golf balls.

Lemelson discloses an adhesive surface dart and shock-absorbing target arrangement wherein a plurality of hook-like projections are disposed on a dart member or similar projectile and a plurality of randomly oriented loop-like fibers are disposed on the target. The design of the projections and fibers is such that upon impact with each other they engageably interlock. This patent is cited for its disclosure of such interlocking means associated with a game or toy.

Although these various devices and apparatus may have provided some advantage to what was known in the art at the time of their conception, there remains a need for an apparatus which may be used indoors for simulation and practice of pitching and chipping, as well as putting strokes. The particular problem which has not been satisfied by any of the disclosed devices or apparatus is how to permit a full pitching or chipping swing including impact with and motion imparted to a golf ball-like object with the target hole positionable at varying distances from the point at which the ball is initially struck. A further consideration is how to simulate the "running" of a shot up to the hole for a pitch and run shot while still providing means to simulate the bite of a ball with backspin when such a ball lands on a green. These and related shortcomings of the disclosed devices and apparatus are overcome by the apparatus of the present invention.

SUMMARY OF THE INVENTION

A golf practice apparatus for pitching, chipping and putting for use indoors, according to one embodiment of the present invention comprises a chipping-putting mat member, a putting green mat member arranged contiguous with said chipping-putting mat member, the putting green mat member having a top surface of loop-like fibers, and a lighter-than-regulation-weight golf ball having an external surface and a plurality of hook-like projections disposed on the external surface, the hook-like projections being of a design suitable for interlocking engagement with the loop-like fibers of the putting green mat.

One object of the present invention is to provide an improved golf practice apparatus for indoor use.

Related objects and advantages of the present invention will be apparent from the following description.

DESCRIPTION OF THE PREFERRED EMBODIMENTS

Figure 1:
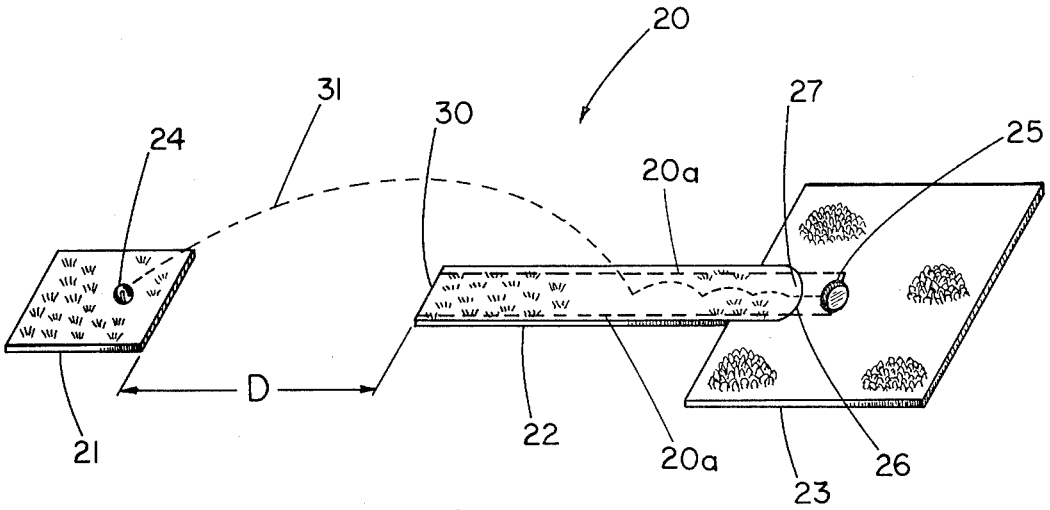
FIG. 1 is a perspective view of a golf practice apparatus according to a typical embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a golf practice apparatus 20 which includes a pitching mat 21, a chipping-putting mat 22, a golf green mat 23 and a lighter-than-regulation-weight golf ball 24. Disposed within the top surface of golf green mat 23 is a golf cup hole 25 which conforms in size and shape to a regulation golf cup hole. Golf green mat 23 also includes a recess 26 which may be virtually any shape so long as it conforms to the shape of curved end 27 of chipping-putting mat 22. In this manner, the chipping-putting mat 22 will lie contiguous with golf green mat 23 so that there will not be a discontinuity between their corresponding top surfaces and a ball which strikes and rolls from one to the other will simulate normal ball travel as if on a continuous green. In lieu of two separate mats, one arrangement is to provide a combined single mat with a chipping-putting mat portion and golf green mat portion as is effectively illustrated by FIG. 1. The preferred location for golf cup hole 25 is within 18 inches of curved end 27. Pitching mat 21 is illustrated as being separated from end 30 of chipping-putting mat 22 by a distance D, and it is to be understood that this distance of separation may be infinitely varied, depending on the desired length of shot which the golfer wishes to practice. A sample trajectory of golf ball 24 is illustrated by broken line 31 which shows golf ball 24 being pitched from pitching mat 21 and landing on chipping-putting mat 22 where it bounces and rolls toward golf cup hole 25. It is assumed that distance D would typically be between 5 and 10 feet for normal indoor use, although significantly greater distances are possible depending upon the available space.

Pitching mat 21 is constructed of a rug-like material such as a conventional filament nylon rug or an artificial turf material having a plurality of closely spaced fibers such as "Astroturf" or the like. A minimum size for pitching mat 21 is approximately 18 inches by 24 inches although virtually any size or shape is possible. The purpose of pitching mat 21 is to provide a specific location for the placement of golf ball 24 and to provide a shielding and cushioning surface in order to protect the floor or floor covering material on which pitching mat 21 rests. This means that missed or errant swings with the particular club will not damage the floor or floor covering surface. Chipping-putting mat 22 (or chipping-putting mat portion) may be constructed of a material similar to that used for pitching mat 21 and a preferred material would be an artificial turf material such as "Astroturf." In order to permit the golf ball 24 to roll somewhat freely across this surface, the top fiber portions may be treated or coated with a lacquer-like material such as a clear polyurethane coating or a plasticizing material. Such a coating will cover over and prevent the presence of fiber loops which would catch and slow down the golf ball. Similarly, the leading edge area around golf cup hole 25 could also be coated, and a suggested coated area is outlined by broken line 20*a* in FIG. 1. Although the coated area could completely extend throughout the top surface of mat 22, a preferred alternative to this is to leave a border of uncoated fibers along the sides of mat 22 as well as around golf cup hole 25, as is illustrated, such that when the golf ball rolls off line or is chipped in an errant direction, the ball will be caught by the fiber loops of these uncoated mat portions.

Figure 2:
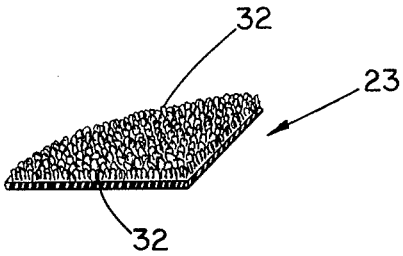
FIG. 2 is a partial detailed view of a putting green mat comprising a portion of the FIG. 1 golf practice apparatus.

Chipping-putting mat 22 is approximately 12 inches in width and extends for a length of approximately 10 feet. Again, as with the size and shape of pitching mat 21, the length and width dimensions of chipping-putting mat 22 may vary greatly. The important consideration concerning the size and shape of chipping-putting mat 22 is that it be wide enough so that shots from pitching mat 21 will land on mat 22 and not on the surrounding floor portion. The length dimension of the coated portion of mat 22 is important in that it be long enough to provide a sufficient running distance for a pitch and run type of golf shot before reaching golf green mat 23. Once golf ball 24 comes in contact with any uncoated portion of the top surface of golf green mat 23 or chipping-putting mat 22, the motion of the ball will be severely restricted. This feature is described below. Golf green mat 23 has a minimum size of approximately 18 inches by 30 inches, although the golf green mat 23 is shown as being proportionately larger than this size. A large size is preferred when it is desired to pitch from mat 21 onto golf green mat 23 due to the possibility of errant shots and the desired protection of nearby objects. Golf green mat 23 includes a top surface of loop-like fibers 32 which are arranged in close proximity to one another in order to simulate a pile or nap-like texture (see FIG. 2). Also, larger sizes of mats may be desirable when incorporating the uncoated border around the coated portion. For example, a 36-inch wide mat 22 with a 9-inch border on each side is preferred when such a coated and uncoated arrangement is involved.

Figure 3:
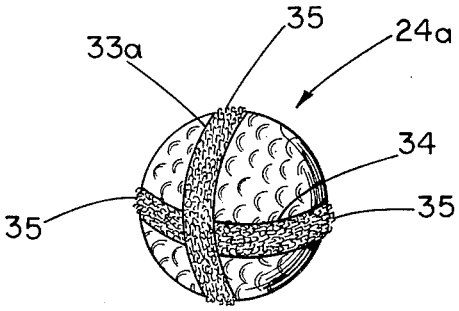
FIG. 3 is a perspective view of a modified golf ball suitable for use with the FIG. 1 golf practice apparatus.
Figure 8:
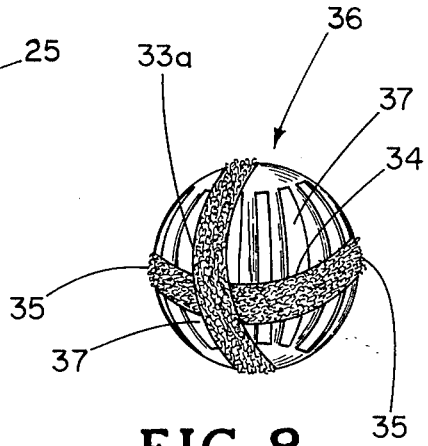
FIG. 8 is a perspective view of an alternative modified golf ball suitable for use with the FIG. 1 golf practice apparatus.
Figure 10:
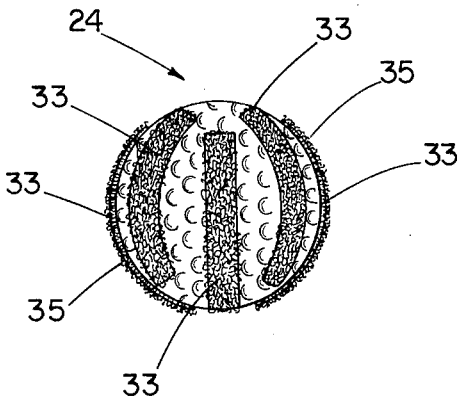
FIG. 10 is a side elevation view of a modified golf ball comprising a portion of the FIG. 1 golf practice apparatus.

Golf ball 24 (see FIG. 10) includes a series of strips 33 around golf ball 24. Each strip 33 includes a plurality of hook-like projections 35 thereon. The uncoated loop-like fibers 32 of golf green mat 23 are suitably designed for interlocking engagement with the hook-like projections 35 of golf ball 24. Consequently, when golf ball 24 reaches an uncoated portion of golf green mat 23, its motion will be severely restricted and it will be stopped abruptly similar to the biting action of a golf ball with a moderate amount of backspin when it hits a green. Golf ball 24 has a weight which is less than the regulation weight of a golf ball and may be, for example, a hollow plastic sphere or alternatively may be filled with a lightweight material. Alternative golf ball designs 24*a* (see FIG. 3) and 36 (see FIG. 8) include a first strip 33*a* of hook-like projections 35 and a second strip 34 of hook-like projections 35 at a right angle to the first strip. Golf ball 36 is hollow and includes a number of openings 37 which increase the air resistance of the ball once it is hit so that its distance of travel will be restricted and so that the ball will be suitable for indoor practice purposes. A golf ball such as golf ball 24 or 24*a* is suitable with or without openings 37 and it is preferred that a hollow plastic ball, such as ball 24, which is of regulation golf ball size, be utilized with golf practice apparatus 20. The preferred weight of golf ball 24 is less than 0.50 ounces and this permits a full pitching or chipping swing to be executed with resultant ball travel limited to only a few feet.

It is important that the material selected for pitching mat 21 and chipping-putting mat 22 be compatible with the hook-like projections of golf ball 24 so that golf ball 24 may be freely hit from pitching mat 21 and will freely move across chipping-putting mat 22 without being caught or otherwise have its motion retarded by any engagement of the surface fibers of mat 21 or mat 22 with the hook-like projections 35. This may be accomplished by coating the surface as has previously been mentioned or by selection of a partcular mat fiber which will not catch the projections 35. The opposite result is desired with respect to golf green mat 23. In that instance, it is required that the hook-like projections 35 interlockingly engage with the surface texture of golf green mat 23, with the exception of that portion leading up to the hole, and a suitable arrangement of loop-like fibers 32 and hook-like projections 35 are "Velcro" fasteners, although there are a number of mat fibers which are also suitable for catching the hook-like projections 35.

Figure 4:
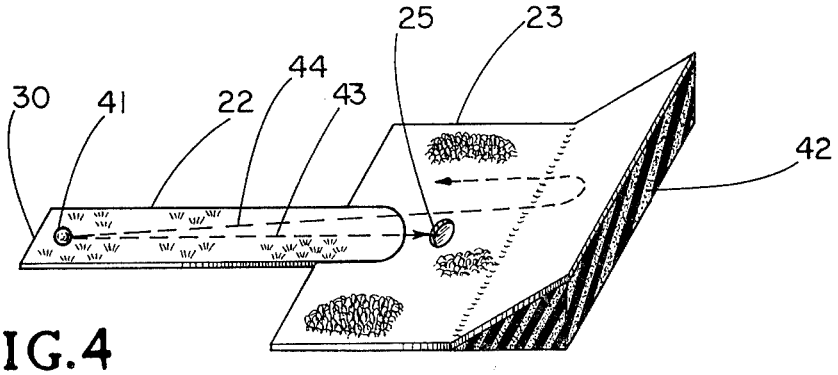
FIG. 4 is a perspective view of a chipping-putting mat and a putting green mat comprising a portion of the FIG. 1 golf practice apparatus.
Figure 5:
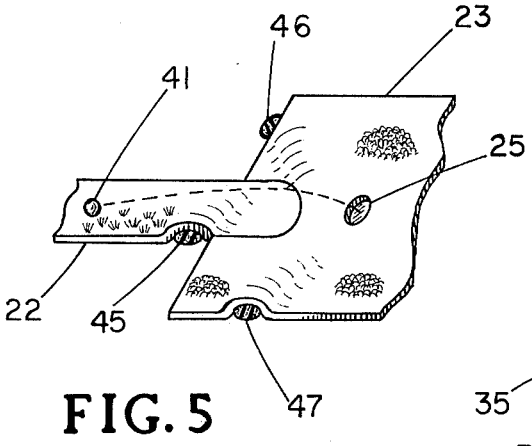
FIG. 5 is a partial perspective view of the FIG. 4 mats as modified in order to provide surface undulations.

FIG. 4 illustrates an alternative arrangement of golf practice apparatus 20 wherein golf practice apparatus 40 does not include a pitching mat but rather includes only the chipping-putting mat 22 and the golf green mat 23 as previously disclosed. Although golf ball 24 could be utilized with apparatus 40 and could be hit from end 30 of chipping-putting mat 22, the preferred use for apparatus 40 is with a regulation golf ball 41 as a practice putting apparatus. In this arrangement, it is important that some means be provided such that a regulation golf ball 41, which could roll well past hole 25 be stopped or in some manner prevented from continuing on to where it might hit another object or possibly break something within the room where apparatus 40 is being used. To provide a backstop and return means, a wedge-shaped member 42 which may be constructed of a lightweight material, such as, for example, polyurethane foam, is inserted beneath golf green mat 23 at a location beyond the hole such that hole 25 is between chipping-putting mat 22 and wedge-shaped member 42. Broken line 43 indicates the trajectory of a properly aligned and hit golf ball which goes into golf cup hole 25. Broken line 44, however, represents the trajectory of an incorrectly stroked golf ball and as illustrated will pass by golf cup hole 25 will roll up the inclined portion of golf green mat 23 which has been created by wedge-shaped member 42 and will then roll back down in a direction toward the point of origin of the golf ball 41. Alternatives to this arrangement are illustrated by FIG. 5 wherein additional foam rubber members 45, 46 and 47 are inserted beneath chipping-putting mat 22 and golf green mat 23 in front of and on the sides of hole 25. These foam rubber members are utilized in order to simulate more closely the rolls and undulations in an actual golf green. These foam rubber members 45–47 may be of virtually any size and shape and may be positioned at any point beneath the two mats that the golfer desires so that an infinite variety of golf green contours can be created. When foam rubber members 45–47 are utilized, it may be preferable to expand the width of chipping-putting mat 22 so that the point of origin of ball 41 for a particular arrangement of foam rubber members can be varied by widthwise movement.

Figure 6:
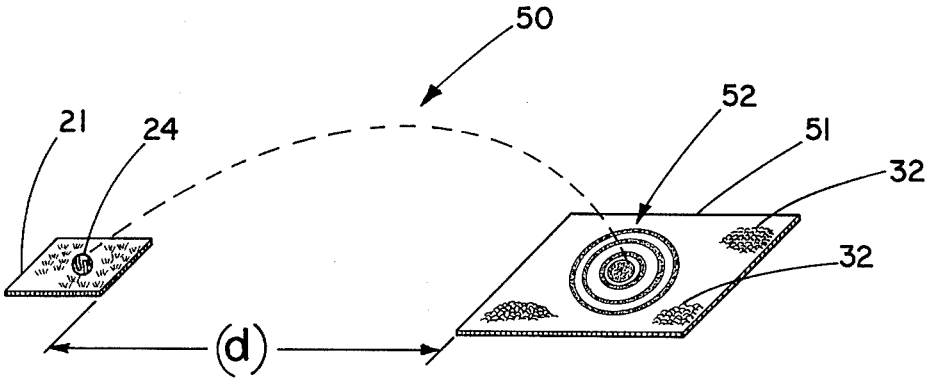
FIG. 6 is a perspective view of an alternative golf practice apparatus according to a typical embodiment of the present invention.

One important aspect of a proper pitching or chipping shot is that the golfer establish an imaginary point or target which he desires for the golf ball to initially hit before it bounces or rolls. This target location is established based upon the golfer's reading of his particular ball lie, the condition of the particular golf green and the distance that the ball is from the golf cup hole. Golf practice apparatus 50 as illustrated in FIG. 6 provides a means by which such target practice may be conducted indoors in a safe and harmless manner. Apparatus 50 includes pitching mat 21, landing mat 52, and golf ball 24, 24*a* or 36. Landing mat 51 is arranged with a top surface of loop-like fibers 32 similar to that arrangement of golf green mat 23 as has been previously disclosed and described. Landing mat 51 also includes target indicia 52 which includes a contrasting series of bands or stripes arranged in circular formation as is typically known. This target indicia 52 is centrally located within landing mat 1 and as golf ball 24 strikes landing mat 51, it will remain at its point of initial contact. This permits the golfer who is practicing to use a plurality of golf balls and to note his accuracy and/or improvement by the closeness of the particular golf balls to the center of target indicia 52. The distance of separation (d) between pitching mat 21 and landing mat 51 may be varied, depending on the particular distance of shot that the golfer wishes to practice.

Figure 7:
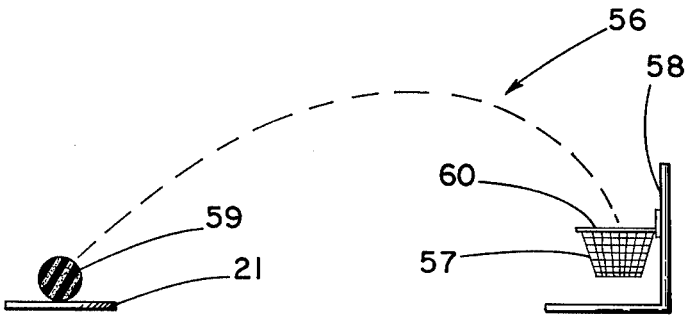
FIG. 7 is a side elevation view of an alternative golf practice apparatus according to a typical embodiment of the present invention.

An alternative form of a golf practice apparatus wherein a target is utilized is illustrated by FIG. 7. Apparatus 56 includes a pitching mat 21, a basket-like receptacle 57 which is oriented in an upright position on a frame 58 and a foam rubber ball 59. Apparatus 56 is utilized by the golfer to practice full or ¾ pitching and chipping swings whereby ball 59 is hit in an upward trajectory toward receptacle 57. The accuracy of the pitching or chipping shot is then governed by how close the golfer comes to placing ball 59 through the top open portion 60 of receptacle 57. The use of apparatus 56 is substantially the same as apparatus 50 although apparatus 56 may provide a more interesting target practice means to certain golfers in that it simulates a basket and basketball combination.

Figure 9:
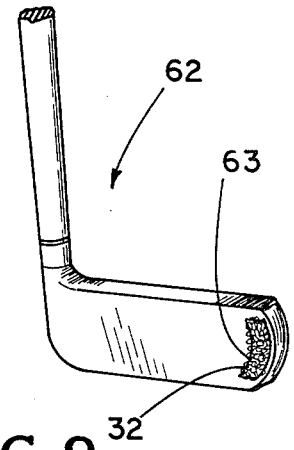
FIG. 9 is a partial perspective view of a golf putter having ball-pickup means and being suitable for use with the FIG. 3, FIG. 8 and FIG. 10 golf balls.
Figure 11:
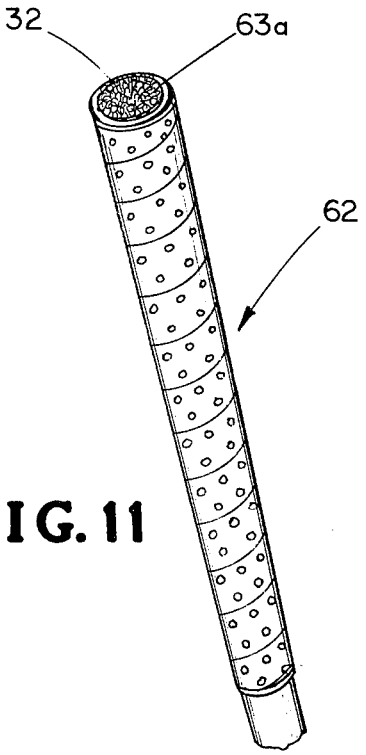
FIG. 11 is a perspective view of a golf putter grip having ball-pickup means and being suitable for use with the FIG. 3, FIG. 8 and FIG. 10 golf balls.

A further component associated with apparata 20, 40 and 50 is golf putter 62 which may be, for example, a conventional golf putter which has been modified by the placing of a patch 63 or 63*a* of loop-like fibers 32 adjacent the toe of the putter (see FIG. 9) or alternatively, on the end of the grip portion (see FIG. 11). In this manner, the loop-like fibers 32 which are on putter 62 may be utilized to pick up golf ball 24 so that the golfer can retrieve his practice shot golf balls without having to bend over. This pickup means provided by patch 63 is particularly helpful to elderly individuals as well as individuals with minor back problems.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A golf practice apparatus for pitching, chipping and putting, for use indoors, said golf practice apparatus comprising:

a chipping-putting mat disposed substantially horizontal and having a top surface;

a putting green mat arranged contiguous with said chipping-putting mat and disposed substantially horizontal, said putting green mat having a top surface of loop-like fibers and a golf-cup-like hole portion disposed in said top surface of said loop-like fibers;

a lighter-than-regulation-weight golf ball having a plurality of hook-like projections disposed thereon, said hook-like projections being of a design suitable for interlocking engagement with said loop-like fibers;

a pitching mat spaced apart from said chipping-putting mat; and the top surface of said chipping-putting mat having a surface design suitable for allowing rolling freedom thereacress by said lighter-than-regulation-weight golf ball.

2. The golf practice apparatus of claim 1 wherein said golf-cup-like hole portion is located within 18 inches of said chipping-putting mat.

3. The golf practice apparatus of claim 2 which further includes a modified golf putter, said putter having a patch of loop-like fibers disposed adjacent the grip portion of said putter, said loop-like fibers being of a design suitable for interlocking engagement with said hook-like projections of said golf ball.

4. The golf practice apparatus of claim 3 wherein said chipping-putting mat includes a border of loop-like fibers disposed along opposite edges of said chipping-putting mat for interlocking engagement with the hook-like projections on said lighter-than-regulation-weight golf ball and the top surface portion between said edges being suitable for allowing said rolling freedom.

* * * * *